US012252980B2

(12) United States Patent
Helle et al.

(10) Patent No.: US 12,252,980 B2
(45) Date of Patent: Mar. 18, 2025

(54) DETERMINATION OF ORDER AND/OR DIRECTION OF DOWNHOLE COMPONENTS

(71) Applicants: Nils Helle, Niedersachsen (DE); Tobias Dressler, Niedersachsen (DE); Michael Szczepanski, Niedersachsen (DE); Markus Hempel, Niedersachsen (DE)

(72) Inventors: Nils Helle, Niedersachsen (DE); Tobias Dressler, Niedersachsen (DE); Michael Szczepanski, Niedersachsen (DE); Markus Hempel, Niedersachsen (DE)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 15 days.

(21) Appl. No.: 17/849,199

(22) Filed: Jun. 24, 2022

(65) Prior Publication Data

US 2023/0024053 A1 Jan. 26, 2023

Related U.S. Application Data

(60) Provisional application No. 63/214,904, filed on Jun. 25, 2021.

(51) Int. Cl.
*E21B 47/09* (2012.01)

(52) U.S. Cl.
CPC ..... *E21B 47/09* (2013.01)

(58) Field of Classification Search
CPC ..... E21B 47/09; E21B 47/12; E21B 17/02
See application file for complete search history.

(56) References Cited

U.S. PATENT DOCUMENTS

2014/0152460 A1* 6/2014 Santoso ..... E21B 47/12 340/854.9
2016/0201444 A1 7/2016 Hardee et al.
(Continued)

FOREIGN PATENT DOCUMENTS

WO 2015026317 A1 2/2015
WO 2020072078 A1 4/2020

OTHER PUBLICATIONS

International Search Report for PCT/US2022/034669, dated Oct. 19, 2022, 3 pages.

*Primary Examiner* — Amine Benlagsir
(74) *Attorney, Agent, or Firm* — CANTOR COLBURN LLP

(57) ABSTRACT

A system for determining an order of electronic components in a downhole string includes a plurality of electronic components connected in series by a conductor and forming a series of electronic components, the plurality of electronic components including a master electronic component. For each electronic component in the series of electronic components, the controller is configured to detect a power direction, where the power direction is an uphole power direction when power from the power supply is received at an uphole side of the electronic component, and is a downhole power direction when power is received at a downhole side of the electronic component. The controller is configured to send a message through the conductor including an indicator indicating the power direction, and the master electronic component is configured to receive the message and determine an order of electronic components in the series of electronic components based on the indicator.

20 Claims, 7 Drawing Sheets

(56) References Cited

U.S. PATENT DOCUMENTS

| | | | | |
|---|---|---|---|---|
| 2016/0265343 | A1* | 9/2016 | Donderici | E21B 47/13 |
| 2017/0002640 | A1 | 1/2017 | Hoefel et al. | |
| 2017/0331280 | A1* | 11/2017 | Koenecke | H02H 3/10 |
| 2019/0271222 | A1* | 9/2019 | Chu | H04L 67/12 |

* cited by examiner

| Element | Description |
|---|---|
| Tool Type | Tool Identifier which is a Unique Number for Each Tool Type |
| IP Address | Automatic Assigned IP Address (IPv4) |
| Power Source Information | Information from which Side the Modem was Powered (UH, DH) |

FIG. 7

| BHA Order (Uphole to Downhole) | Power Source |
|---|---|
| Master | Not Applicable |
| Tool 2 | UH |

FIG. 8

| BHA Order (UH to DH) | Power Source |
|---|---|
| Tool 1 | Downhole |
| Master | Not Applicable |
| Tool 2 | Uphole |

FIG. 9

| BHA Order (UH to DH) | Power Source |
|---|---|
| Tool 1 | Downhole |
| Master | Not Applicable |
| Tool 2 | Uphole |
| Tool 3 | Uphole |

FIG. 10

DETERMINATION OF ORDER AND/OR DIRECTION OF DOWNHOLE COMPONENTS

CROSS REFERENCE TO RELATED APPLICATIONS

This application claims priority to U.S. Provisional Application Ser. No. 63/214,904, filed on Jun. 25, 2021, the contents of which is incorporated herein by reference in its entirety.

BACKGROUND

In the resource recovery industry, a number of diverse activities are performed in a borehole penetrating an earth formation, including exploration and production operations. Typically, exploration involves surveying and performing measurements known as logging using a survey or logging tool. Production generally involves activities such as drilling, installing permanent installations, casing perforation, hydraulic fracturing, formation evaluation, well integrity surveys, well stimulation, production logging, pressure pumping and cement evaluation. Some of the different tools used in various operations require electrical power supply, which may be supplied from a surface location or a downhole location.

SUMMARY

An embodiment of a system for determining an order of electronic components in a downhole string includes a plurality of electronic components connected in series by a conductor and forming a series of electronic components, the plurality of electronic components including a master electronic component, where each electronic component in the series of electronic components includes an uphole side and a downhole side. The system also includes a power supply operably connected to the series of electronic components, and a controller in each electronic component. For each electronic component in the series of electronic components, the controller is configured to detect a power direction, where the power direction is an uphole power direction when power from the power supply is received at the uphole side of the electronic component, and the power direction is a downhole power direction when power is received at the downhole side of the electronic component. The controller is also configured to send a message through the conductor, where the message includes an indicator indicating the power direction, and the master electronic component is configured to receive the message and determine an order of electronic components in the series of electronic components based on the indicator in the message.

An embodiment of a method of determining an order of electronic components in a downhole string includes deploying the downhole string, the downhole string including a plurality of electronic components connected in series by a conductor and forming a series of electronic components, the plurality of electronic components including a power supply and a master electronic component, where each electronic component in the series of electronic components includes an uphole side and a downhole side. The method also includes, for each electronic component in the series of electronic components, detecting a power direction by a controller of an electronic component, where the power direction is an uphole power direction when power from the power supply is received at the uphole side of the electronic component, and the power direction is a downhole power direction when power is received at the downhole side of the electronic component. The method further includes sending a message through the conductor, where the message includes an indicator indicating the power direction, receiving the message by the master electronic component, and determining an order of the electronic components in the series of electronic components based on the indicator in the message.

BRIEF DESCRIPTION OF THE DRAWINGS

The following descriptions should not be considered limiting in any way. With reference to the accompanying drawings, like elements are numbered alike:

FIG. 7 depicts an embodiment of format of an identification message transmitted from a downhole component;

FIG. 8 depicts an example of a record of an order of connected downhole components relative to a first downhole component, based on an identification message from a component located uphole from the first downhole component;

FIG. 9 depicts the record of FIG. 8, updated based on an identification message from a component located downhole from the first downhole component;

FIG. 10 depicts the record of FIGS. 8 and 9, updated based on an identification message from another component located downhole from the first downhole component;

DETAILED DESCRIPTION

Figure 1:
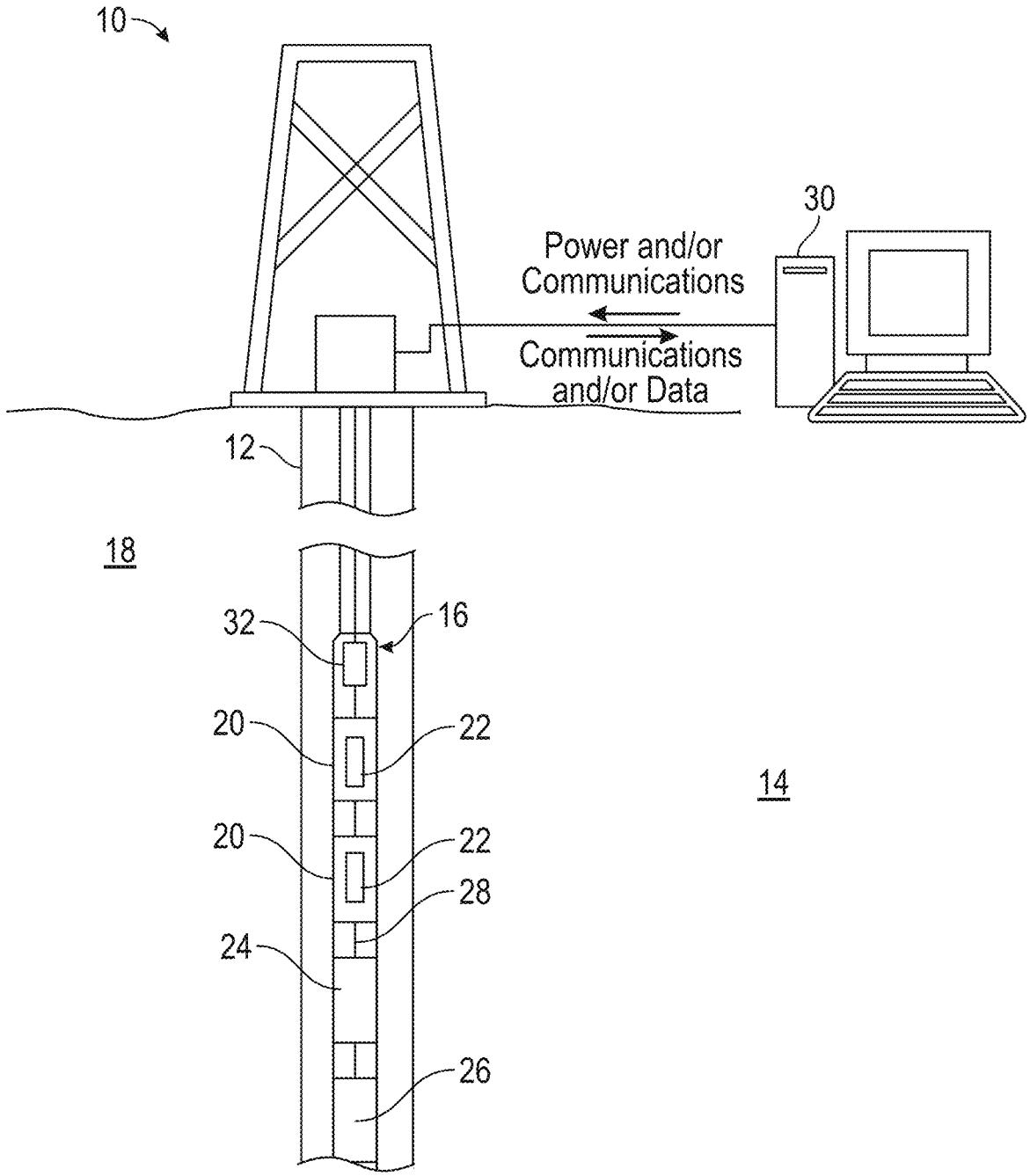
FIG. 1 depicts an embodiment of a system including a plurality of downhole tools configured to be disposed in a borehole in an earth formation.

A detailed description of one or more embodiments of the disclosed apparatus and method are presented herein by way of exemplification and not limitation with reference to the Figures.

Systems, apparatus and methods are provided herein for determining an order of downhole components along a borehole string and/or for determining a direction of a downhole component relative to one or more other downhole components. Each downhole component may include a communication device for connecting the downhole component to a downhole conductor such as a borehole string bus, cable or wireline. The communication device and downhole conductor may be configured for any type of communication, such as electrical, radiofrequency optical and others. The downhole conductor may be an electrical conductor, an optical conductor (e.g., an optical fiber or fibers) or any other suitable conductor or combination of conductors. The downhole conductor may be the same conductor as a power line, or may be a separate conductor An embodiment of a downhole component, also referred to herein as a component or electronic component, is configured to receive a message from another component via the conductor, and determine a direction (e.g., uphole or downhole) of the other component based on the message. The direction of the component relative to another component is referred to herein as a "component direction." The component direction may be used to determine a direction of a tool ("tool direction"). If the downhole component receives messages from a plurality of other components, the downhole component may determine an order of the other components based on receiving such messages.

A "tool" refers to a device or system deployed with the borehole string 12, and may include or be connected to a component. A "component" refers to a device (e.g., a modem) or combination of devices that can be utilized to determine an order of connected components and/or an order of tools as described herein.

In an embodiment, the downhole component may determine the order of the other components based on a receipt time of each message, information from each message or using any other suitable technique. In an embodiment, the order of components may be determined based on a chronological order of the reception of each message.

An embodiment of a downhole component includes features related to determining a direction from which power is supplied to the downhole component. This direction is referred to as a "power direction" or "voltage direction." The power direction may be derived by measuring or detection of current or voltage, magnetic fields or other methods. It is noted that the component direction and the voltage or power direction may be a direction along a borehole and/or a borehole string, e.g., an uphole direction or a downhole direction.

For example, a plurality of downhole components are arrayed along a borehole string, and include a first component and a plurality of other components that are connected to the conductor (referred to as "connected components"). The plurality of downhole components are arrayed in series along a communication line (e.g., a bus). That is, a first component is connected to a maximum of two connected components, i.e., a second component and a third component. The second component and the third component are either uphole or downhole of the first component. Each of the second and third component are connected to the first component by a conductor.

The plurality of components are connected in series, such that two components of the series of components ("end components") are connected to only one other component via the bus or communication line in the series (an end component may be connected to other devices or entities, such as a tool or processor). Accordingly, the series of components connected to the bus has endpoints (i.e., the components are not connected by the bus or communication line as a loop). These are the two components located at the two ends of the series. The series may include three or more components and have any desired number of components.

For example, a series of three components includes a first component connected to two connected components (a second component and a third component), and the second component and the third component are connected to only the first component. The communication line that connects all connected components in the series of components with each other provides to all connected components the same voltage and the same communication (data, messages, information). As each connected component is powered, the connected component determines a power direction, i.e., a direction from which power is supplied thereto (uphole or downhole direction). The first component may include or be connected to a power supply, or otherwise configured to control the supply of power to the connected components.

Each connected component then sends a message (e.g., along the conductor or via any other suitable communication system) to the first component that indicates the power direction associated with that component. The first component receives a message from each connected component. The order of the connected components (relative to each other and relative to the first component) may be determined based on the chronological sequence of the messages, and the component direction is determined based on the information provided by the message. For example, if a connected component transmits a message that indicates an uphole power direction, the first downhole component can determine that the connected component is downhole of the first component (i.e., the component direction is a downhole direction). Determination of component direction and/or order may be performed during a start-up sequence, during an operation or at any other desired time.

In an embodiment, each connected component includes a circuit breaker assembly, a shunt resistor or other device or assembly that allows the component to determine a direction (power direction) from which the connected component is powered. The connected component determines the power direction (e.g., uphole or downhole), and can communicate the power direction to the first component or another connected component (e.g., other connected components, a master component, a controller and others). The power direction information allows, for example, the first component (which may be a master component or controller) to determine whether the connected component is uphole or downhole from the first component based on the message transmitted by the connected component indicating the power direction of the connected component. In an embodiment, the first component is a master component or controller (e.g., a bottomhole assembly (BHA) controller) configured to control power to connected components and downhole tools (e.g., tools and devices in a BHA).

In an embodiment, the first downhole component is configured as a master component (e.g., BHA controller), which is configured to perform various functions and may control aspects of other components, such as connected components. For example, the master component may include a power source and/or control power provided to other components. Other functions may include communicating with the surface and/or controlling functions of other components.

Embodiments described herein present a number of advantages. For example, embodiments of the system provide for determination of both tool order and tool direction based on the sequence of messages received from each tool, in combination with information from each tool regarding the direction from which each tool is powered. This allows a component such as a power unit or master controller to determine, in parallel, the order of tools both uphole and downhole of the power unit or master component. The embodiments thus reduce the amount of time needed to determine tool order as compared to conventional systems.

FIG. 1 illustrates an embodiment of a system 10 for performing energy industry operations such as drilling a borehole 12 in an earth formation 14, formation measurement and/or evaluation, hydrocarbon production, completion and/or stimulation. The system 10 includes a borehole string or tool string 16 configured to deploy one or more downhole tools in the borehole 12. Examples of borehole strings include coiled tubing, drill strings, jointed pipes, casing strings, liner strings, other tubulars, or any combination thereof.

Any number of downhole tools may be deployed in the borehole. For example, the tool string 16 includes an array or string of downhole tools 20 (referred to herein as a "tool string"). For example, the tools are configured to perform downhole measurements, and each tool 20 includes a sensing device 22 configured to perform downhole measurements such as temperature, pressure and/or flow rate. The sensing device may be configured to emit energy (e.g., acoustic, optical, seismic, electromagnetic, neutron radiation, etc.) into the formation 14 and receive signals due to interaction with the formation 14. Other examples of tools include a formation testing tool 24 for extracting a sample of the formation and/or formation fluid via, for example, a fluid sample port or a coring tool. Further examples include a stimulation tool 26 configured to perform or facilitate performing a stimulation operation such as a hydraulic fracturing operation, and a flow control device for injecting fluid into the formation 14 and/or receiving fluid from the formation 14. Other types of downhole tools are also contemplated, such as steering devices or systems, logging while drilling (LWD) tools, measurement while drilling (MWD) tools, directional sensors, and secondary cutting devices such as expandable reamers or stabilizers. It is noted that the use of the term "tool" is intended to encompass any device that can be deployed downhole. A tool and a tool string may include an inner bore configured to allow drilling fluid to flow through the tool string.

One or more of the downhole tools are configured to communicate with the surface by a communication system. Examples of such communication systems include mud pulse telemetry (positive or negative), electromagnetic telemetry, ultrasonic sound, electrical conductor (e.g., a wireline, wired pipe, cable or wire, optical fiber and others). In an embodiment, the downhole tools are connected to one another by a bus or other conductor 28. The conductor 28 may include a single line conductor that extends along the borehole string 16 to provide power to multiple tools arrayed along the string. The conductor 28 may be formed from an electrically conductive material (e.g., a wire), an optical fiber or a wireless connection. In an alternative embodiment, the conductor 28 may comprise a plurality of lines (e.g., wires, optical fibers or wireless channels).

In one embodiment, the downhole tools are connected by electrical conductors to each other, which provide electrical power to the tools and may also provide communication between each other. At least one of the tools provides electrical power (e.g., by generating electrical power from mud flow or by a battery disposed at or connected to the tool), or at least controls the supply of power to other tools. A conductor in a first tool is connected to a conductor in a second tool through a connector in the tool connection, such as a pin or box connection. The connector may be an electrical connector or an optical connector. The connector may be disposed at any suitable location. For example, the connector is located in a shoulder of the tool connection. In another example, the connector of a tool is a central connector located in the inner bore of the tool or tool string.

In case of a single line conductor, the tool connection may host a single line connector, such as a ring connector, a partial ring connector, or a pin connector. The tool body may form the ground contact, ground line or ground potential, while the single line conductor and connector carries the power and/or communication signal.

In an embodiment, the downhole tools are connected by conductors to each other, which provide electrical power and may provide communication to each other. Each tool may include a processing device for performing functions that include power monitoring, data acquisition, data processing, control of the tools, communication with other tools, etc.

In an embodiment, the system 10 includes a surface processing unit 30, which may provide or facilitate power transmission to the downhole tools, and may also send and receive data and communications to and from the downhole tools. A subsurface processing unit 32 may also be disposed in the borehole 12 and connected to one or more of the downhole tools.

Figure 2:
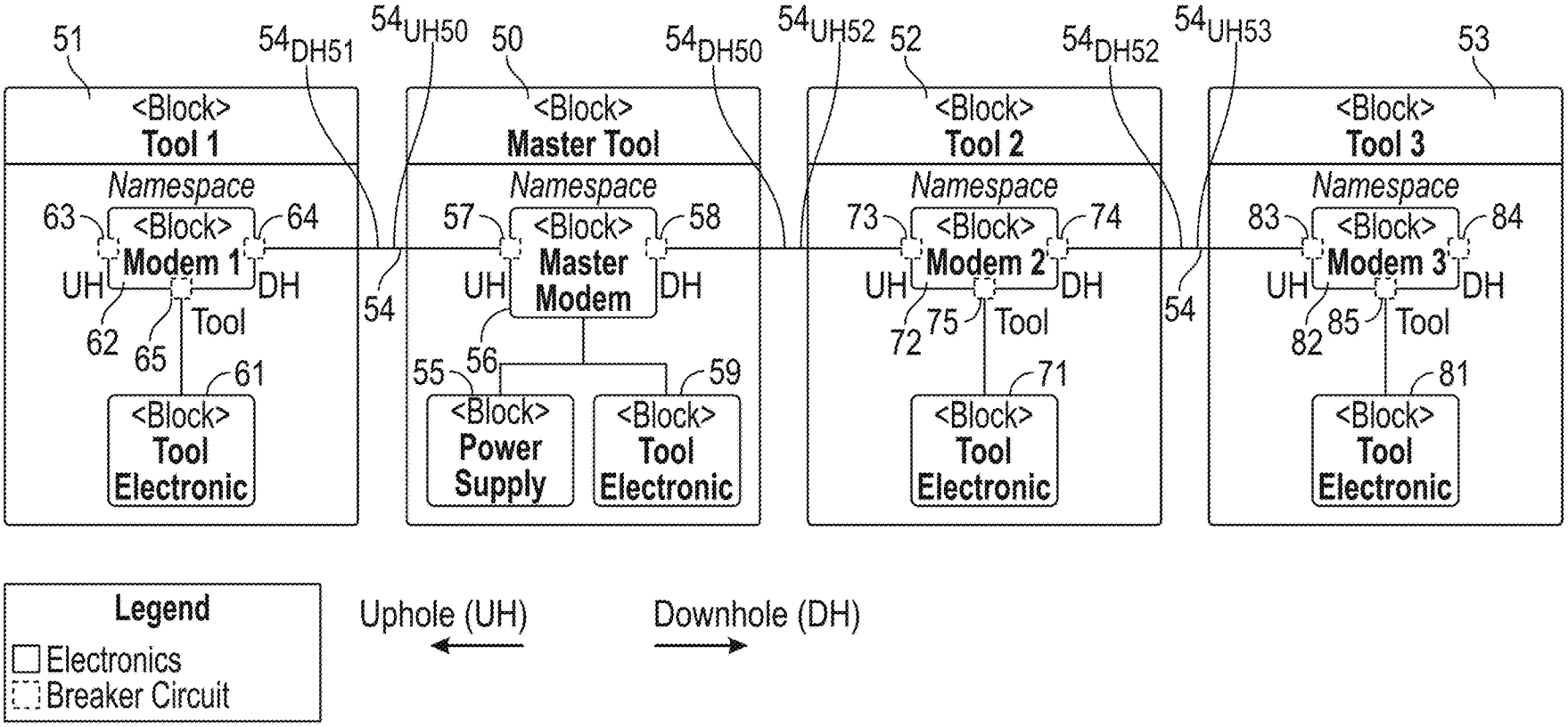
FIG. 2 depicts an embodiment of a portion of a borehole string including a first component configured to communicate with, and control the supply of power to, a plurality of connected components.

FIG. 2 depicts an embodiment of a portion of a borehole string that includes a plurality of tools. Each tool includes one or more components configured to provide communication and power supply. In this embodiment, each component includes a modem, and may further include a controller or processor and at least one breaker circuit. The controller or processor and/or the at least one breaker circuit may be integrated into the modem (e.g., on one circuit board) or may be a separate device (e.g., on separate circuit boards).

In this embodiment, the string includes an array of tools 50, 51, 52 and 53, and may be a bottomhole assembly (BHA), but is not so limited. The tool 51 may also be referred to as "Tool 1", the tool 52 may also be referred to as "Tool 2", and the tool 53 may also be referred to as "Tool 3". One of the tools (the tool 50) is configured as a power control device, and may function as a master controller that communicates with the other tools and provides power to the other tools over a bus 54 or other conductor. For example, the tool 50 is configured as a master tool 50 and includes a power supply 55 and a master electronic circuit or master modem 56 that controls the supply of power to the tools 51, 52 and 53. The master modem 56 includes a controller or processor. The master tool 50 and the tools 51, 52 and 53 each include electronics devices such as a processor, memory, communication device (modem) and/or other suitable electronics devices. Although the power supply 55 is shown as internal to the master tool 50, the power supply 55 may be located at another location, e.g., on the borehole string or at the surface. Tools 51 and 53 are end components and are both connected to only one other component through the bus 54.

The master tool 50 is connected to the bus or conductor 54 so as to communicate with tools uphole (UH) and downhole (DH) relative to the master tool 50. Two conductors are leaving the master tool 50, one at the uphole connection of the tool 50 and the other at the downhole connection of the tool 50. For example, the master tool 50 is connected to the bus 54 via an uphole circuit breaker 57 and a downhole circuit breaker 58. An uphole circuit breaker may also be referred to as an upper circuit breaker, and a downhole circuit breaker may also be referred to as lower circuit breaker. In this example, the tool 51 is located uphole relative to the master tool 50, and thus the tool direction for the tool 51 is defined as an uphole direction from the master tool 50. The tools 52 and 53 are located downhole relative to the master tool 50, and thus the tool direction for tools 52 and 53 is defined as a downhole direction from the master tool 50. It is noted that the component directions (and power directions) may be defined by an axis of the borehole string or borehole. A tool is in the "uphole tool direction" relative to a reference location or reference tool if the tool is closer to the surface (along the borehole string axis) than the reference location or reference tool, and a tool is in the "downhole tool direction" if the tool is further from the surface than the reference location or reference tool. In an embodiment the reference tool is the master tool 50.

Each tool 51, 52 and 53 includes a component, such as a communication device, (e.g., a modem), that is configured to connect the tool to the bus or conductor 54 and provides communication and controls power supply. For example, the tool 50 includes tool electronics 59, a modem 56 and a power supply 55. The tool 51 includes tool electronics 61 and a modem 62, the tool 52 includes tool electronics 71 and a modem 72, and the tool 53 includes tool electronics 81 and a modem 82. When the tools are connected in series, the components in the tools are also connected in series. The component in the master tool 50 is the master modem 56, the component in the tool 51 is the modem 62, the component in the tool 52 is the modem 72, and the component in the tool 53 is the modem 82. The component direction of the modem 62 is defined as an uphole direction from the master modem 56, the component direction for the modem 72 and the modem 82 is defined as a downhole direction from the master modem 56.

In an embodiment, each component, or the modem in the component, includes or is connected to a circuit breaker assembly that can be used by a respective tool to determine the power direction or voltage direction, i.e., the direction from which power is supplied. For example, the modem 62 includes or is connected to an upper breaker circuit 63 and a lower breaker circuit 64. The tool electronics 61 are connected to the modem 62 via a central breaker circuit 65. The modem 72 includes or is connected to an upper breaker circuit 73 and a lower breaker circuit 74, and the tool electronics 71 are connected to the modem 72 by a central breaker circuit 75. The modem 82 includes or is connected to an upper breaker circuit 83 and a lower breaker circuit 84, and the tool electronics 81 are connected to the modem 82 by a central breaker circuit 85. Although the breaker circuits are each shown as part of a modem, they are not so limited and can be incorporated in or connected to any suitable device, or provided as a separate device Each modem may be connected to the bus via suitable conductors. For example, the tool 52 and the modem 72 are connected to the bus 54 at an uphole side by a conductor $\mathbf{54}_{UH52}$ and connected to the bus 54 at a downhole side by a conductor $\mathbf{54}_{DH52}$. The master tool 50 and the master modem 56 are connected to the bus 54 at an uphole side by a conductor $\mathbf{54}_{UH50}$, and at a downhole side by a conductor $\mathbf{54}_{DH50}$. Likewise, the tool 51 and the modem 62 are connected to the bus 54 at a downhole side by a conductor $\mathbf{54}_{DH51}$, and the tool 53 and the modem 82 are connected to the bus 54 at an uphole side by a conductor $\mathbf{54}_{UH53}$.

It is noted that the downhole components, the power supply and the master controller may communicate via any suitable technique or configuration. For example, communication may be performed through the bus or conductor 54 using, for example, a powerline communication (PLC) protocol, or any other communication protocol (e.g., an ethernet protocol, a controller area network (CAN) protocol, a serial communication protocol, a modbus protocol, a profibus protocol, and others). In other examples, communication between components may be accomplished using means other than the bus or conductor 54, e.g., using a separate electrical, electro-magnetic or optical conductor. In an example, the connected tools 51, 52 and 53 are each equipped with a communication device (e.g., a modem), and tool specific tool electronics.

In the embodiment of FIG. 2, the master tool 50 controls the supply of power to each tool, for example, by operating the breaker circuits 57 and 58. As discussed further herein, the master tool 50 may perform an initialization procedure/sequence that includes a component discovery sequence (Tools 1-3). As a result of the initialization sequence, the master tool 50 can identify the relative locations of each tool in one direction, and also determine the direction of each tool (uphole or downhole). For example, the master tool 50 identifies the tool 51 as an uphole tool, and identifies the tools 52 and 53 as downhole tools and the successive positions of the tools 52 and 53 (the tool 53 is downhole of the tool 52).

Figure 3:
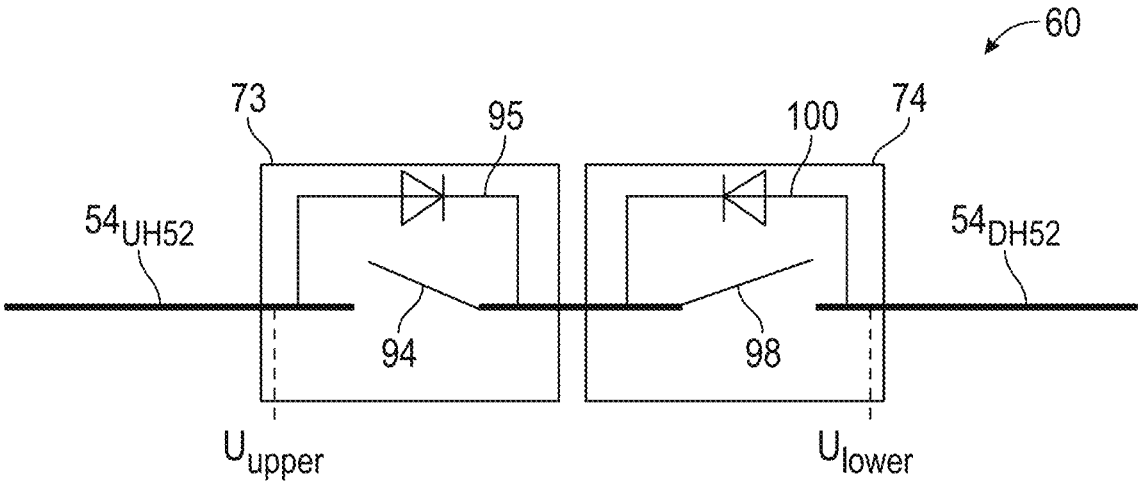
FIG. 3 depicts an embodiment of a power control and communication device of a downhole component.

FIG. 3 depicts an embodiment of a circuit breaker assembly 60 that may be used by a tool to determine a voltage or power direction for that tool. The circuit breaker assembly 60 may be incorporated in each tool that is connected to the master tool 50 or power supply 55. The circuit breaker assembly 60 (or an individual breaker circuit) either is included in the modem (e.g., the modem 56, 62, 72 or 82), or is in a separate device or circuit (e.g., a separate electronics board (PCBA)). This embodiment is discussed in conjunction with the tool 52 for illustration purposes. It is noted that a similar circuit breaker assembly 60 may be included in each tool 51 and 53.

The circuit breaker assembly 60 includes the upper breaker circuit 73 connected to the bus or conductor 54. The connection may be provided by the conductor $\mathbf{54}_{UH52}$. The lower breaker circuit 74 is connected to the bus or connector 54. The connection may be provided by the conductor $\mathbf{54}_{DH52}$. The breaker circuits may be controlled by the modem 72 to connect the modem 72 to a power supply and/or to relay power from a power supply to other tools. The modem 72 controls power supply to any other electronics in the tool 52.

The upper breaker circuit 73 includes an upper breaker switch 94, and a circuit component such as a diode 96 for powering the modem 72 from an uphole power direction. The upper breaker switch 94 is also referred to herein as an uphole breaker switch. The diode 96 can be used to bypass a breaker switch, such as the upper breaker switch 94, and power the modem 72 when the upper breaker switch 94 is open and power is supplied from the uphole power direction. The lower breaker circuit 74 includes a lower breaker switch 98, and a circuit component such as a diode 100 for powering the tool electronics 71 from a downhole power direction. The lower breaker switch 98 is also referred to herein as a downhole breaker switch. The diode 100 can be used to power the modem 72 when the lower breaker switch 98 is open and power is supplied from the uphole power direction. The diode 100 is configured to bypass a breaker switch, such as the lower breaker switch 98. It is noted that an upper or uphole direction or location may not necessarily be physically above a lower or downhole location, e.g., in a horizontal section of a borehole.

Each modem may be connected to any suitable device or assembly for determining power direction, and is not limited to the above breaker assembly. For example, the tool 51, 52 and/or 53 may include multiple shunt resistors (power direction determined by measuring and comparing the voltages on both ends of the tool), or one or multiple magnetic field sensing devices may be used to determine direction of current flow, thus identifying from where the tool is powered.

Figure 4:
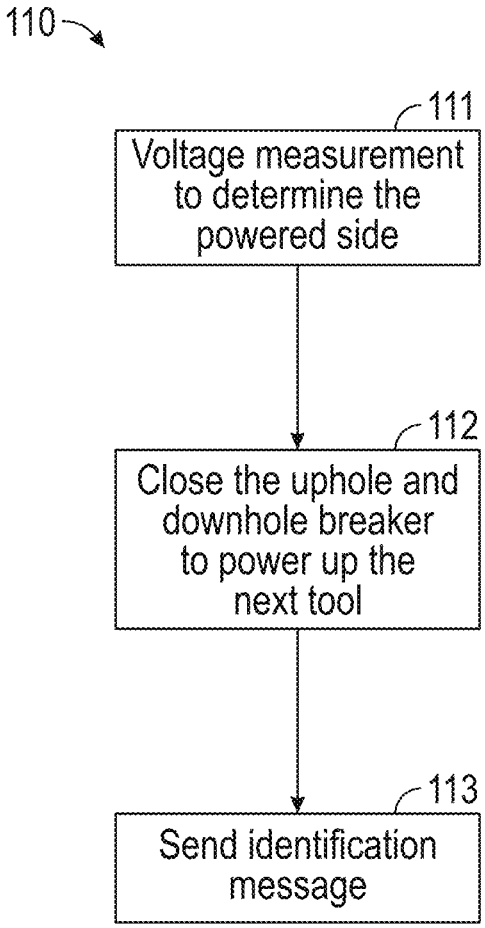
FIG. 4 is a flow chart depicting an embodiment of a method of powering a downhole component and determining a direction from which power is supplied to the downhole component.

FIG. 4 is a flow chart that illustrates an embodiment of a method 110 of determining a direction from which power is supplied to a downhole component, such as a downhole component in the tool 51, 52 or 53. The method 110 is discussed in conjunction with the circuit breaker assembly 60 of FIG. 3, but is not so limited. The method 110 includes one or more stages 111-113. In one embodiment, the method 110 includes the execution of all of the stages 111-113 in the order described. However, certain stages may be omitted, stages may be added, or the order of the stages changed.

The method 110 may be performed at any suitable time. In one embodiment, the method 110 is performed during a startup or initialization procedure of the tool string and/or the master tool 50 and any other connected tool.

At the first stage 111, a downhole component performs one or more measurements to determine whether power is supplied by a power supply from an uphole or downhole direction. Measurements may include current measurements, voltage measurements, magnetic field measurements, or any other measurement relevant to determining power direction. The voltage may be measured by a voltage measurement device in the component (e.g., modem), or in an associated tool. A voltage measured from an uphole power direction (e.g., uphole the upper breaker 63, 73 or 83) is denoted $U_{upper}$, and a voltage measured from a downhole power direction (e.g., downhole the lower breaker 64, 74 or 84) is denoted $U_{lower}$.

For example, for tool 52 (Tool 2), the tool electronics 71 measures voltage at the upper breaker circuit 73 and above the breaker switch 94 ($U_{upper}$), and measures voltage at the lower breaker circuit 74 below the breaker switch 98 ($U_{lower}$). The voltage is measured against the tool ground. If a sufficient voltage is detected at the upper breaker circuit 73, the tool 52 determines that the power direction is uphole. Likewise, if sufficient voltage is detected at the lower circuit 74, the tool 52 determines that the power direction is downhole.

At the second stage 112, the downhole component (e.g., modem) closes the upper and/or lower breaker circuits to power the associated tool (e.g., to power the tool electronics 71). The downhole component closes both the upper and lower breaker circuits 73 and 74 to transmit power to other tools above or below.

At the third stage 113, the downhole component transmits a message to another component that indicates the power direction. The other component (receiving component) can use this information to determine the direction of the transmitting component relative to the receiving component. For example, the tool 52 sends a message, (also referred to as an "identification message") including information indicating the power direction, via the bus or conductor 54 to the master modem 56 in the master tool 50. The identification message is used by the master modem 56 to determine the component direction of the tool 52, e.g., for registration purposes. The identification message may be modulated on a communication bus, such as the bus or conductor 54. Every modem (or other component) connected to the bus 54 can read the identification message. The message may include an address so that only the addressee component is reading the message on the bus, as for example the master modem 56.

In an embodiment, a tool such as the master tool 50 with the master modem 56 is configured to perform an initialization, power-up or startup procedure. During a startup phase or initialization procedure, components are sequentially powered by a power supply. For example, the circuit breakers in each tool 51, 52 and 53 are closed one after another, and each tool sends an identification message to the master modem 56 when it receives power. The messages are received sequentially as a chronological message sequence, and the physical order of the connected tools are determined based on the time and/or chronological order of the received identification messages.

Figure 5:
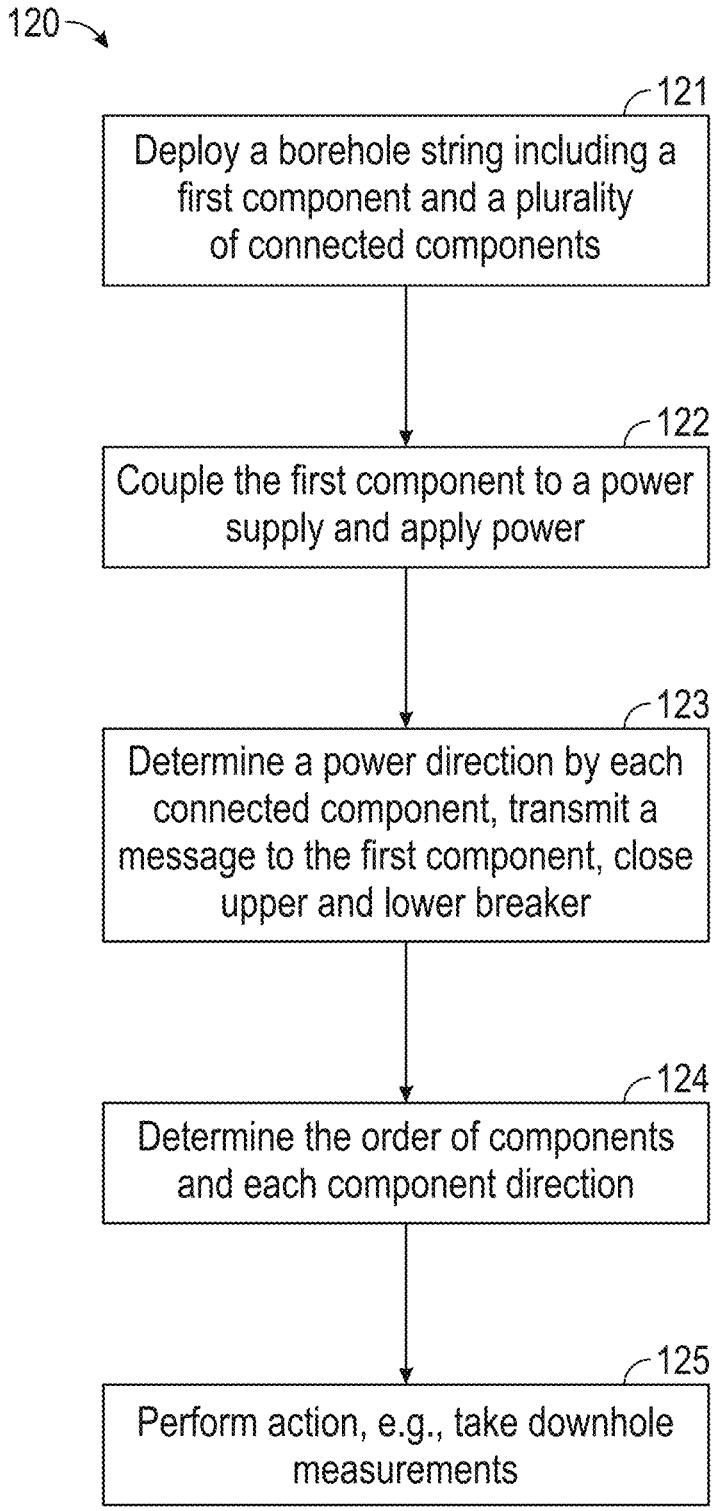
FIG. 5 is a flow chart depicting an embodiment of a method of providing power to a plurality of downhole components and determining an order of the downhole components along a borehole string.

FIG. 5 is a flow chart that illustrates an embodiment of a method 120 of determining an order and/or direction of one or more components that are connected to a first component. The first component may be a designated master component and/or power supply component, but is not so limited.

Figure 6:
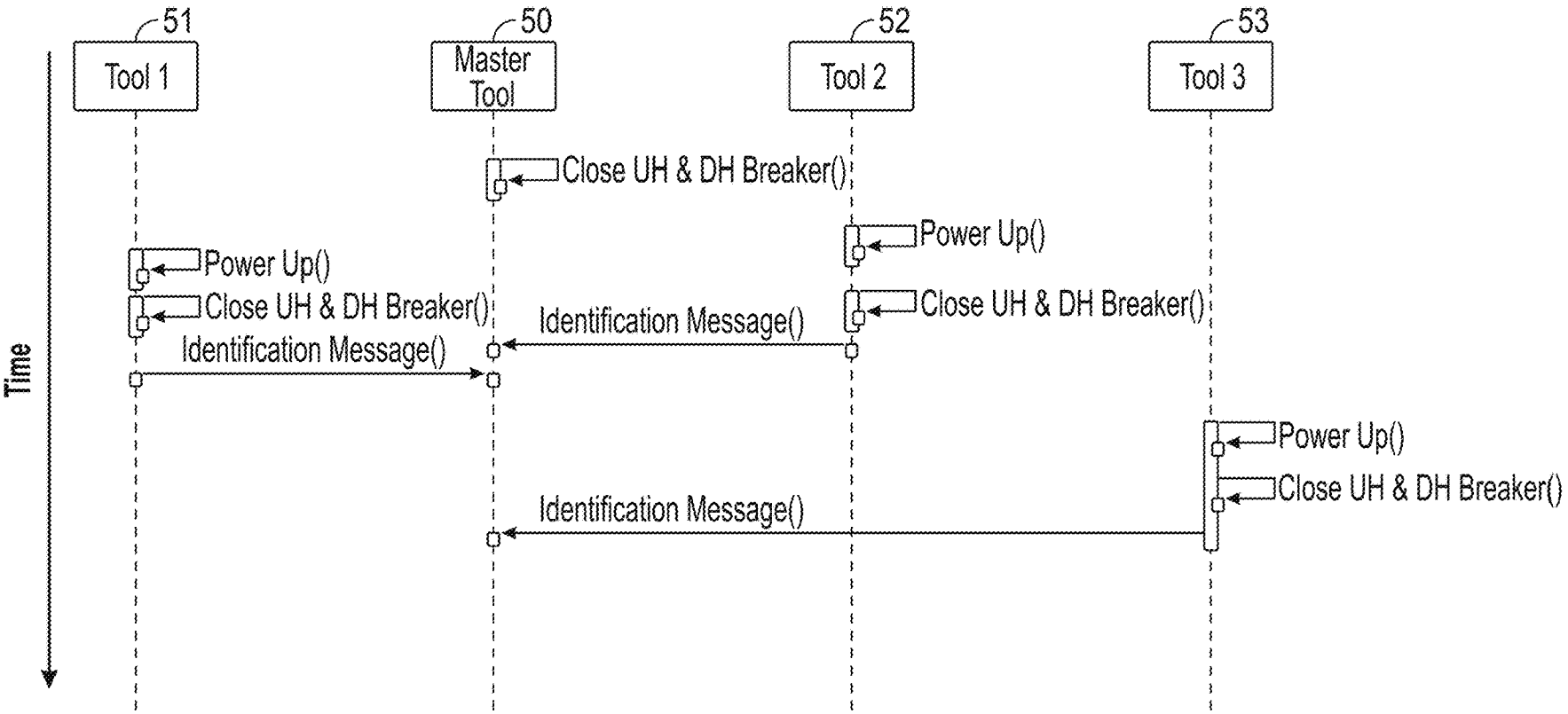
FIG. 6 depicts an example of the portion of the borehole string of FIG. 2, and an example of an initialization procedure.

The method 120 is discussed in conjunction with an example of an initialization procedure performed by a surface or downhole component that is connected to the one or more connected components, aspects of which are shown in FIG. 6.

Generally, during an initialization procedure, the physical setup of connected downhole components is evaluated, including the order of components and whether the components are uphole or downhole from a reference location (e.g., location of a master component or master tool). In an embodiment, the components are connected in series, and the components at the start and end of the series (end components) are each connected to only one other component. The procedure typically includes successively powering sections of the conductor or bus 54 and successively powering the components, potentially with a delay between each section to allow individual components to initialize. In the example of FIG. 6, the master modem 56 in the master tool 50 determines the order of connected components both uphole and downhole, including modems 62, 72, 82, and any other connected components. It is noted that the method 120 is not limited to such a procedure, and can be performed at any desired time.

The method 120 includes one or more stages 121-125. In one embodiment, the method 120 includes the execution of all of the stages 121-125 in the order described. However, certain stages may be omitted, stages may be added, or the order of the stages changed.

At stage 121, a borehole string is disposed in a borehole. The borehole string includes a plurality of downhole components, one of which may be a master modem including a controller and/or configured to supply power to other components. For example, a borehole string including tools 50-54 is deployed in a borehole.

At stage 122, a first component is coupled to a power supply and commences to apply power to a conductor in the borehole string that connects the other components.

For example, the master modem 56 controls power up to commence an initialization phase, by closing the upper and lower breaker circuits 57 and 58 to connect the power supply to the bus 54 and supply power thereto (via conductors $54_{UH50}$, and $54_{DH50}$). There may be a delay between closing the upper breaker circuit 57 and the lower breaker circuit 58 to facilitate distinguishing between uphole and downhole components. The delay may be controlled by the master modem 56 (e.g., as a predefined delay) or may be a natural delay caused by the sequential steps of the initialization process. The delay may be very short (nano seconds or microseconds) or may be in a range of milliseconds or a few seconds.

At stage 123, each connected component determines the direction of power applied thereto, and returns a message (identification message) to the first component indicating the power direction.

For example, as shown in FIG. 6, when the modem 62 in tool 51 (Tool 1) is powered (e.g., the controller in the modem 62 is powered over one diode), the modem 62 measures voltage at the upper and lower breaker circuits 63 and 64, and determines that power is supplied from a downhole direction. The tool 51 then generates and transmits an identification message indicating the power direction as downhole. The modem 62 then closes the upper and lower breakers circuits 63 and 64. In an embodiment, the modem 62 may first send the identification message and then close the upper and lower breaker circuits 63 and 64. The modem 62 also closes the central breaker 65 to provide power to the tool electronics 61. In case there is no tool uphole the tool 51, the upper breaker 63 may still be opened by the modem 62. In an alternative embodiment, the modem 62 may not open the upper breaker 63 if no further component is located uphole the tool 51. There may be a termination sub uphole of the tool 51 to terminate the bus 54.

The modem 72 in tool 52 (Tool 2) is powered over a diode in the upper breaker circuit 73 or a diode in the lower breaker circuit 74. The modem 72 measures voltage at the upper and lower breaker circuits 73 and 74, determines that power is supplied from an uphole direction, and transmits an identification message including an indication that the power direction is uphole. The modem 72 then closes the upper and lower breaker circuits 73 and 74. In an embodiment, the modem 72 may first send the identification message and then close the upper and lower breaker circuits 73 and 74. The modem 72 also closes the central breaker 75 to provide power to the tool electronics 71.

Closing the breaker circuits of the tool 52 allows for power to be subsequently supplied to the modem 82 in the tool 53. The tool 53 similarly closes its breaker circuits 83 and 84, determines the power direction (uphole) and transmits an identification message or alternatively transmits an identification message and closes the breaker circuits 83 and 84.

In this way, components uphole from the first component are sequentially powered, and components downhole from the first component are sequentially powered.

At stage 124, the first component receives an identification message from each connected component, which indicates the power direction associated with a respective component. The identification message may include other information, such as a component identifier and/or information related to component attributes and functions, such as Internet Protocol (IP) Address.

In an embodiment, the identification message may comprise only the power direction information and no other information. The message in this embodiment is referred to here as a "direction message." The direction message (which may be a part of the identification message or a stand-alone direction message) may include a complex message using more than one bit, or may use only one bit to indicate the power direction (e.g., 1=uphole, 0=downhole or vice versa). In the initialization process, a DHCP protocol may be used to assign an IP addresses to each modems in each tool. In an alternative embodiment, another protocol may be used to assign IP addresses to the modems. It is noted that the identification message and/or direction message may be transmitted using any suitable protocol, and locations may be assigned using any address protocol or format.

In an embodiment, the first component identifies from each identification message whether a respective connected component is powered from uphole or downhole, and groups the respective components into, for example an uphole group and a downhole group. In an embodiment, components that identify an uphole power direction are grouped as downhole components (having a downhole component direction), and components that identify a downhole power direction are grouped as uphole components.

For example, the modem 56 in the master tool 50 receives an identification message from the tool 51 that includes the indication of a downhole power direction. The modem 56 in the master tool 50, based on this message, determines that the tool 51 direction (the component direction) is an uphole direction. The modem 56 in the master tool 51 also receives an identification message from the tool 52. As the tool 51 and the tool 52 are both directly neighboring tools to the master tool 50 (no other tool in between), the identification messages arrive at almost the same time.

Introducing a delay (direction delay) between closing the breakers 57 and 58 in the master tool 50 (as described earlier) makes the identification messages from tools located directly uphole and downhole the master tool arriving at a slightly later point in time (the direction delay). It is noted that depending on whether closing the upper breaker circuit 57 or the lower breaker circuit 58 is delayed, the identification messages from the uphole or downhole will arrive delayed. If closure of the upper breaker 57 is delayed (relative to closure of the lower circuit breaker 58), the identification messages from the uphole direction will arrive later than the identification messages from the downhole direction. If closure of the lower breaker circuit 58 is delayed, the identification messages from the downhole direction will arrive later than the identification messages from the uphole direction. In this way, introduction of a delay can facilitate identification of direction and grouping of connected components.

It is noted that delaying the arrival of identification messages is not required. For example, if there is no breaker delay in closing the upper and lower breaker circuits 57 and 58, and the identification messages from the uphole and downhole directions arrive at the same time or substantially the same time, determination of the component direction may be performed based on component direction information in the identification message.

The modem 56 in the master tool 50 may receive a sequence of messages, i.e., an identification message from the tool 52 followed by an identification message from the tool 53 at a time interval later (distance delay). The timing (chronological order) of received messages may be used to determine tool order. For example, as shown in FIG. 6, the identification messages arrive at the master modem 56 in a chronological sequence. As the breaker circuits in each of the series of components (modems) are closed one after the other, components located further from the master component (modem 56) send identification messages later (distance delay). In the example of FIG. 6, the identification message of the modem 82 in the tool 53 (Tool 3) arrives last, after the identification messages from the modems 62 and 72 of the tools 51 and 52 (Tool 1 and Tool 2). The distance delay may be in the order of microseconds, milliseconds or seconds.

In this way, the modem in the master tool can determine the order of both uphole components and downhole components in parallel.

At stage 125, various operational actions are performed using the components. For example, components may be used to measure properties of a formation, control stimulation or perform other functions. Other functions may include assigning sensor offsets to tools that then may be used for depth alignment of formation evaluation measurements for downhole purposes, such as downhole log creation or geosteering purposes.

In another example, the distance from the bit may be used to perform drilling dependent corrections to sensor readings. In a further example, the tool order may be used to perform position dependent calibration procedures. Other examples include bending detection and bending qualification based on distributed bending sensors along a BHA to identify local doglegs or buckling, and interpolation of dynamic data measurements such as accelerometer or magnetometer sensor measurements based on the order of the sensors in the BHA.

In an embodiment, the first component generates and maintains a record of each component, including the order of components in an uphole direction and a downhole direction. The record may identify the order based on component direction (e.g., identify the order of physical locations), or power direction (e.g., identify the order of power supplied from uphole to downhole, or downhole to uphole) and chronological order of the reception of identification messages at the modem in the master tool.

The order of all (or a subset of) components in a series, as determined by the master tool 50 (which can occur at any time and/or on a continuous or periodic basis) can be made available to other tools and/or components in the borehole string. As an example, a message including information about discovered tools and/or components (and their order) could be broadcasted to all tools. Alternatively, this message could be sent only to selected tools. Another option is that the tools send a message to the BHA controller to request the information about the discovered tools and/or components and their order.

FIG. 7 depicts an example of a format of a message that may be generated and transmitted by a connected component. In this example, the message includes a tool type element, which may be a unique numerical identifier, or any other identifier code for each connected tool. Examples of identifiers may be or include a serial number, a hardware address, a MAC address, an IP address, a CAN identifier, a Modbus address, etc.

For example, an address element may be included in a message to identify a network address (e.g., IP address) of a connected component. A power source information element provides information as to the power direction, e.g., uphole (UH) or downhole (DH) (component direction). In case there are more than one modem in a tool the tool type message may be the same, but the network address will be different.

FIGS. 8-10 show an example of the generation of a component list or record by the master tool 50. The record lists the master tool 50 and all identified tools 51-53 in the order in which they are positioned relative to the master tool 50. In this example, the master and tools are listed in order from an uppermost tool to a lowermost tool.

As shown in FIG. 8, when the master tool 50 receives an identification message from the tool 52 uphole from the master, the master adds an entry that includes an identifier for the tool 52 (Tool 2) and an indicator of the power direction (UH). As shown in FIG. 9, the master tool 50 receives a message from the tool 51 and updates the record to include an identifier (Tool 1) and power direction (DH). Subsequently, the master tool receives a message from the tool 53, and updates the record as shown in FIG. 10. As is demonstrated, the record not only describes the order of components but also specifies the position of the master tool relative to the connected components.

As an alternative to table type recording of the tool order in a BHA, other recording methods may be utilized, including simple numbering of the tools or assigning alphabetic characters to tools, to more complicated coded methods or schemes. It is to be noted that the detection of the tool order may be performed automatically by the BHA without any interference from the surface or a human being. Automatic or autonomous actions are actions that are performed by a device in the absence of an instruction or command from another entity. Such autonomous actions may be performed in response to inputs such as current measurements, voltage measurements, or any other relevant measurements or data acquired by sensors controlled by the device or measurements or data received from another device or separate sensor.

Figure 11:
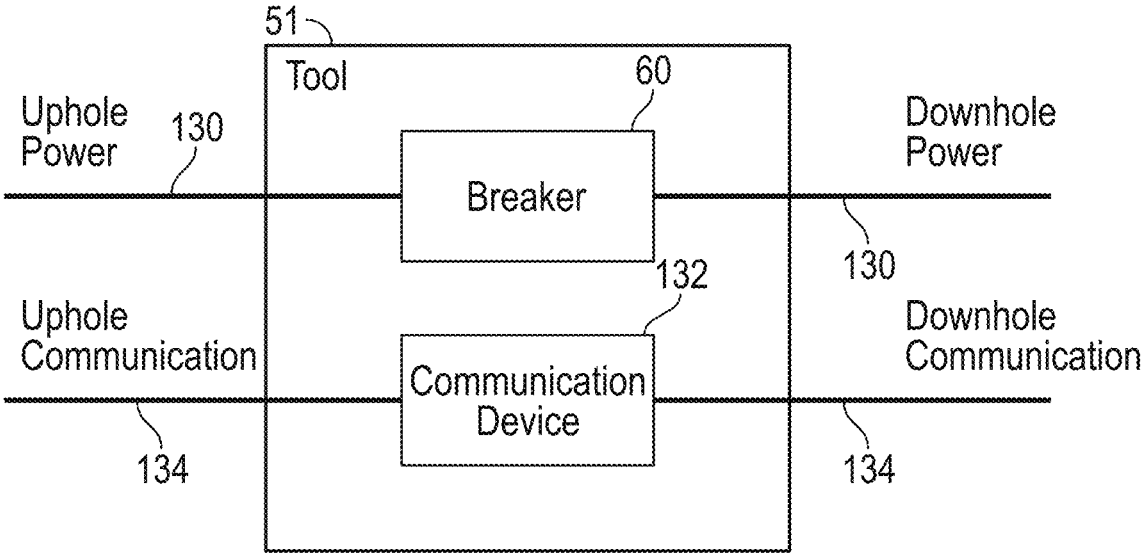
FIG. 11 depicts an example of a downhole component, which may be a component configured to communicate with and control the supply of power to a plurality of connected components, or may be one of the connected components.
Figure 12:
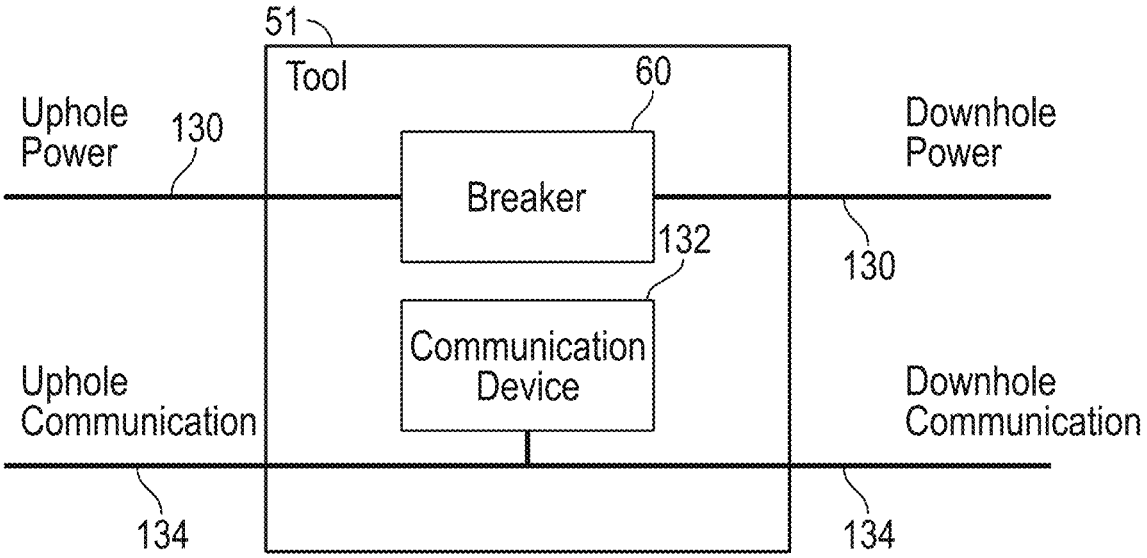
FIG. 12 depicts an alternative configuration of the downhole component of FIG. 11.

The circuit breaker assembly 60 and tools discussed herein are not limited to the specific configuration shown in FIGS. 2, 3 and 6, but may have any configuration that allows for performing functions such as determining voltage or power direction. FIGS. 11 and 12 depict additional examples of a tool that can perform the functions described herein.

FIGS. 11 and 12 illustrate examples in which the circuit breaker assembly 60 and a modem or other component are connected to separate conductors. A tool such as the tool 51 (Tool 1) includes the circuit breaker assembly 60 connected to a first conductor 130, such as the bus 54 or other electrical conductor that extends both uphole and downhole from the breaker assembly 60. A communication device 132, such as a modem, is connected as a component (e.g., as part of a series of components) to a second separate conductor 134 that extends both uphole and downhole from the communication device 132. The communication device 132 can be connected in series with the second conductor as shown in FIG. 11, or can be connected in parallel or via another conductor as shown in FIG. 12.

Set forth below are some embodiments of the foregoing disclosure:

Embodiment 1: A system for determining an order of electronic components in a downhole string, including: a plurality of electronic components connected in series by a conductor and forming a series of electronic components, the plurality of electronic components including a master electronic component, wherein each electronic component in the series of electronic components includes an uphole side and a downhole side; a power supply operably connected to the series of electronic components; and a controller in each electronic component, the controller configured to perform, for each electronic component in the series of electronic components: detecting a power direction, wherein the power direction is an uphole power direction when power from the power supply is received at the uphole side of the electronic component, and the power direction is a downhole power direction when power is received at the downhole side of the electronic component; and sending a message through the conductor, wherein the message comprises an indicator indicating the power direction; wherein the master electronic component is configured to receive the message and determine an order of electronic components in the series of electronic components based on the indicator in the message.

Embodiment 2: The system of any prior embodiment, wherein the master electronic component is configured to determine an order of downhole tools in the downhole string based on the order of the electronic components in the series of electronic components.

Embodiment 3: The system of any prior embodiment, wherein the master electronic component is configured to determine the order of the electronic components in the series of electronic components using a reception time of the message.

Embodiment 4: The system of any prior embodiment, wherein the master electronic component is configured to create a record of the order of the electronic components in the series of electronic components.

Embodiment 5: The system of any prior embodiment, wherein detecting the power direction includes measuring one of a voltage and a current.

Embodiment 6: The system of any prior embodiment, wherein each electronic component of the plurality of electronic components includes an uphole switch and a downhole switch, and each electronic component of the plurality of electronic components includes a measurement device configured to measure one of a voltage and a current uphole of the uphole switch and configured to measure one of a voltage and a current downhole of the downhole switch.

Embodiment 7: The system of any prior embodiment, wherein the electronic component is a modem.

Embodiment 8: The system of any prior embodiment, wherein each electronic component of the plurality of electronic components comprises at least one diode.

Embodiment 9: The system of any prior embodiment, wherein the conductor hosts a bus system, including a communication protocol.

Embodiment 10: The system of any prior embodiment, wherein the bus system connects the electronic components in the series of electronic components, and the series of electronic components includes two end components, each end component connected to only one other electronic component in the series of electronic components by the bus system.

Embodiment 11: The system of any prior embodiment, wherein the message further comprises one of an Internet Protocol (IP) address, and information identifying the electronic component.

Embodiment 12: The system of any prior embodiment, wherein the master electronic component includes an uphole switch and a downhole switch, and the master electronic component is configured to close the uphole switch and the downhole switch with a delay between the closing of the uphole switch and the downhole switch.

Embodiment 13: A method of determining an order of electronic components in a downhole string, comprising: deploying the downhole string, the downhole string including a plurality of electronic components connected in series by a conductor and forming a series of electronic components, the plurality of electronic components including a power supply and a master electronic component, each electronic component in the series of electronic components including an uphole side and a downhole side; performing, for each electronic component in the series of electronic components: detecting a power direction by a controller of an electronic component, wherein the power direction is an uphole power direction when power from the power supply is received at the uphole side of the electronic component, and the power direction is a downhole power direction when power is received at the downhole side of the electronic component; and sending a message through the conductor, wherein the message comprises an indicator indicating the power direction; and receiving the message by the master electronic component, and determining an order of the electronic components in the series of electronic components based on the indicator in the message.

Embodiment 14: The method of any prior embodiment, further comprising determining an order of downhole tools in the downhole string based on the order of the electronic components in the series of electronic components.

Embodiment 15: The method of any prior embodiment, wherein the conductor hosts a bus system that connects the electronic components in the series of electronic components, the series of electronic components includes two end components, and each of the two end components is connected to only one other electronic component in the series of electronic components by the bus system.

Embodiment 16: The method of any prior embodiment, wherein determining the order of the electronic components in the series of electronic components is based on a reception time of the message.

Embodiment 17: The method of any prior embodiment, further comprising creating a record of the order of the electronic components in the series of electronic components.

Embodiment 18: The method of any prior embodiment, wherein each the electronic component of the plurality of electronic components includes an uphole switch and a downhole switch, and each electronic component of the plurality of electronic components includes a measurement device configured to measure one of a voltage and a current uphole of the uphole switch and configured to measure one of a voltage and a current downhole of the downhole switch.

Embodiment 19: The method of any prior embodiment, wherein the plurality of electronic components include a first electronic component and a second electronic component, and the method comprises closing an uphole switch of the first electronic component to provide power to the second electronic component located on the uphole side when the power is detected on the downhole side, and closing a downhole switch of the first electronic component to provide power to the second electronic component located on the downhole side when the power is detected on the uphole side.

Embodiment 20: The method of any prior embodiment, wherein the master electronic component includes an uphole switch and a downhole switch, and the method comprises closing the uphole switch and the downhole switch with a delay between the closing of the uphole switch and the downhole switch.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of +8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A system for determining an order of a plurality of electronic components in a downhole string, comprising:

the plurality of the electronic components connected in series by a conductor and forming a series of the electronic components, each electronic component of the plurality of the electronic components including an electronic circuit, the plurality of the electronic components including a master electronic component, wherein said each electronic component in the series of the electronic components includes an uphole side and a downhole side;

a power supply operably connected to the series of the electronic components; and a plurality of controllers including a controller in said each electronic component of the series of the electronic components, each controller configured to perform, for said each electronic component in the series of the electronic components:

detecting a power direction, wherein the power direction is an uphole power direction when power from the power supply is received at the uphole side of said each electronic component, and the power direction is a downhole power direction when the power is received at the downhole side of said each electronic component;

wherein:

the plurality of controllers includes a first controller in a first electronic component of the series of the electronic components, the first controller configured to send a first message through the conductor at a first time, wherein the first message comprises a first indicator indicating a first power direction;

the plurality of controllers includes a second controller in a second electronic component of the series of the electronic components, the second controller configured to send a second message through the conductor at a second time, wherein the second message comprises a second indicator indicating a second power direction; and the master electronic component is configured to receive the first message at a first reception time and receive the second message at a second reception time, and determine the order of the plurality of the electronic components in the series of the electronic components using the first power direction sent with the first message, the second power direction sent with the second message, the first reception time, and the second reception time.

2. The system of claim 1, wherein the master electronic component is configured to determine an order of downhole tools in the downhole string based on the order of the plurality of the electronic components in the series of the electronic components.

3. The system of claim 1, wherein the master electronic component is configured to create a record of the order of the plurality of the electronic components in the series of the electronic components.

4. The system of claim 1, wherein detecting the power direction includes measuring one of a voltage and a current.

5. The system of claim 1, wherein the electronic circuit of said each electronic component of the plurality of the electronic components includes an uphole switch and a downhole switch, and said each electronic component of the plurality of the electronic components includes a measurement device configured to measure one of a voltage uphole and a current uphole of the uphole switch and configured to measure one of a voltage downhole and a current downhole of the downhole switch.

6. The system of claim 1, wherein said each electronic component is a modem.

7. The system of claim 1, wherein said each electronic component of the plurality of the electronic components comprises at least one diode.

8. The system of claim 1, wherein the conductor hosts a bus system, including a communication protocol.

9. The system of claim 1, wherein the first message and the second message further comprise one of an Internet Protocol (IP) address and information identifying said each electronic component.

10. The system of claim 1, wherein the master electronic component includes an uphole switch and a downhole switch, and the master electronic component is configured to close the uphole switch and the downhole switch with a delay between the closing of the uphole switch and the downhole switch.

11. The system of claim 1, wherein the plurality of controllers includes a third controller in a third electronic component in the series of the electronic components, the third controller configured to send a third message through the conductor, and wherein the master electronic component receives the first message and the second message on one of the uphole side and the downhole side, and the master electronic component receives the third message on another of the uphole side and the downhole side.

12. The system of claim 1, wherein the master electronic component is included in a master tool and the master tool includes the power supply.

13. A method of determining an order of a plurality of electronic components in a downhole string, comprising:

deploying the downhole string, the downhole string including the plurality of the electronic components connected in series by a conductor and forming a series of the electronic components, each electronic component of the plurality of the electronic components including an electronic circuit, the plurality of the electronic components including a power supply and a master electronic component, said each electronic component in the series of the electronic components including an uphole side and a downhole side;

performing, for said each electronic component in the series of the electronic components: detecting a power direction by a controller of said each electronic component in the series of the electronic components, wherein the power direction is an uphole power direction when power from the power supply is received at the uphole side of said each electronic component, and the power direction is a downhole power direction when the power is received at the downhole side of said each electronic component; and sending a first message through the conductor at a first time by a first controller in a first electronic component of the series of the electronic components, wherein the first message comprises a first indicator indicating a first power direction;

sending a second message through the conductor at a second time by a second controller in a second electronic component of the series of the electronic components, wherein the second message comprises a second indicator indicating a second power direction; and receiving the first message and the second message by the master electronic component, the first message received at a first reception time and the second message received at a second reception time, and determining the order of the plurality of the electronic components in the series of the electronic components using the first power direction sent with the first message, the second power direction sent with the second message, the first reception time and the second reception time.

14. The method of claim 13, further comprising determining an order of downhole tools in the downhole string based on the order of the plurality of the electronic components in the series of the electronic components.

15. The method of claim 13, further comprising creating a record of the order of the plurality of the electronic components in the series of the electronic components.

16. The method of claim 13, wherein the electronic circuit of said each electronic component of the plurality of the electronic components includes an uphole switch and a downhole switch, and said each electronic component of the plurality of the electronic components includes a measurement device configured to measure one of a voltage uphole and a current uphole of the uphole switch and configured to measure one of a voltage downhole and a current downhole of the downhole switch.

17. The method of claim 13, further comprising one of (i) closing an uphole switch of the first electronic component to provide the power to the second electronic component located on the uphole side of the first electronic component when the power is detected on the downhole side of the first electronic component, and (ii) closing a downhole switch of the first electronic component to provide the power to the second electronic component located on the downhole side of the first electronic component when the power is detected on the uphole side of the first electronic component.

18. The method of claim 13, wherein the master electronic component includes an uphole switch and a downhole switch, and the method comprises closing the uphole switch and the downhole switch with a delay between the closing of the uphole switch and the downhole switch.

19. The method of claim 13, wherein the determining of the order of the plurality of the electronic components in the series of the electronic components is performed inside a borehole by the master electronic component without interference from a surface of the earth or a human being.

20. The method of claim 13, further comprising sending a third message by a third controller in a third electronic component of the series of the electronic components, wherein the master electronic component receives the first message and the second message on one of the uphole side and the downhole side, and the master electronic component receives the third message on another of the uphole side and the downhole side.

* * * * *